United States Patent [19]

Polack

[11] 4,004,297

[45] Jan. 25, 1977

[54] TROUSER CONSTRUCTION

[76] Inventor: George Polack, 66 Isabella St., Apt. 1601, Toronto, Ontario, Canada

[22] Filed: Jan. 26, 1976

[21] Appl. No.: 652,201

[52] U.S. Cl. ..... 2/227; 2/229; 2/403; 2/DIG. 1

[51] Int. Cl.[2] ..... A41D 1/06; A41B 9/00

[58] Field of Search ..... 2/227, 237, 236, 229, 2/311, 220, 221, 403, 404, 400, DIG. 1

[56] References Cited

UNITED STATES PATENTS

| | | | |
|---|---|---|---|
| 464,916 | 12/1891 | Taylor | 2/237 X |
| 1,662,981 | 3/1928 | Pazowski | 2/237 X |
| 2,574,678 | 11/1951 | Wilbur | 2/311 X |
| 3,280,405 | 10/1966 | Fruhwirth | 2/229 X |
| 3,555,569 | 1/1971 | Jones | 2/237 |
| 3,793,646 | 2/1974 | Tempelhof | 2/227 |

*Primary Examiner*—H. Hampton Hunter

[57] ABSTRACT

A trouser construction in which the front part of the waistband is much lower than the back. The back portion of the waistband fits around the "small" of the back of the wearer, i.e. in the waist region of the body, and the side portions of the waistband are angled downwardly to follow essentially the line of juncture between the abdomen and the legs. The front portion of the waistband will cover only the lowermost portion of the abdomen. The waistband will not suspend the trousers on the body of the wearer, but will simply provide points of attachment by means of which the trousers may be suspended for example by suspenders, or by attachment to the shirt of the wearer.

9 Claims, 10 Drawing Figures

FIG. 8
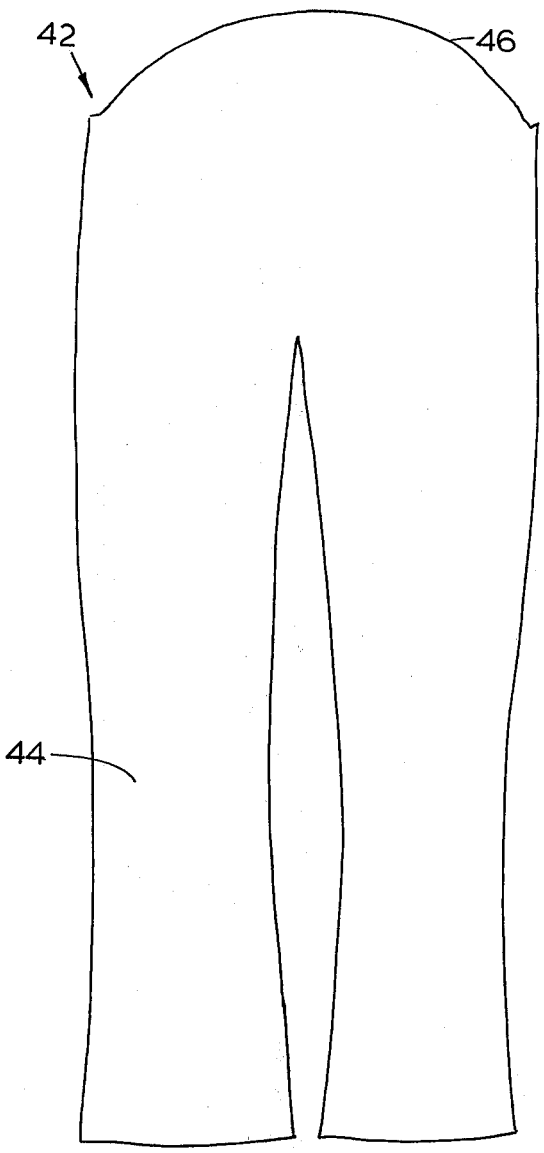
FIG. 9
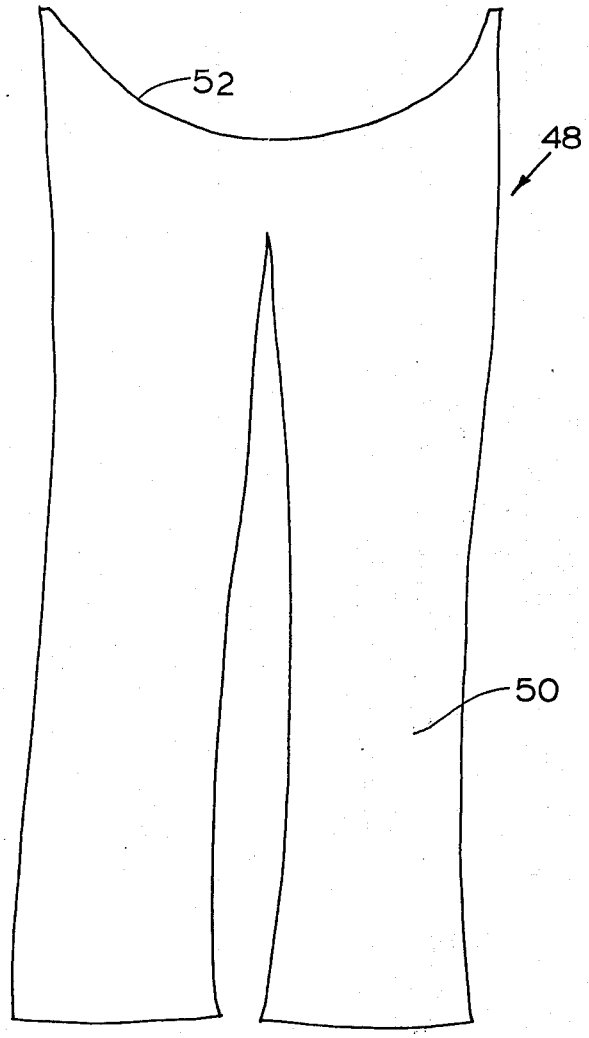
FIG. 6
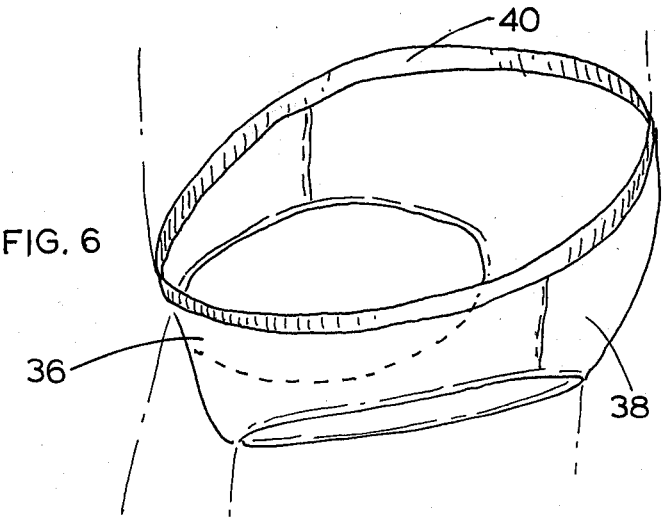
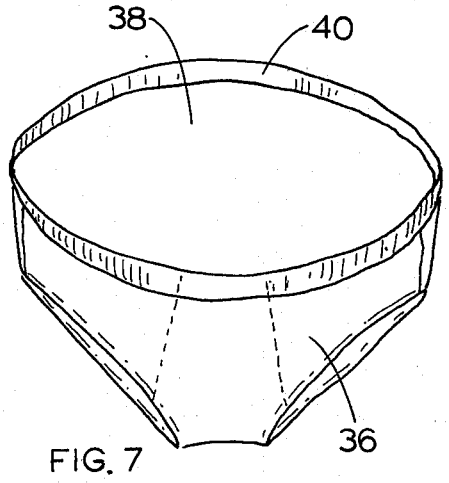
FIG. 7

TROUSER CONSTRUCTION

The present invention relates to the construction of trousers, and in particular, to the construction of trousers more compatable with the human body than those presently in use.

BACKGROUND OF THE INVENTION

Conventional trouser construction requires a waistband by means of which the trousers are held up on the body of the wearer. The waistband encircles the abdomen of the wearer. When the wearer sits down, the waistband constricts the abdomen and in many cases causes discomfort. The constriction of the abdomen for extended periods of time in this way is undesirable, and is believed to cause constipation, and overweight, and impairs the function of the bowels.

BRIEF SUMMARY OF THE INVENTION

The present invention provides a trouser construction in which the front part of the waistband is much lower than the back. The back portion of the waistband fits around the "small" of the back of the wearer, ie. in the waist region of the body, and the side portions of the waistband are angled downwardly to follow essentially the line of juncture between the abdomen and the legs. The front portion of the waistband will cover only the lowermost portion of the abdomen.

The waistband will not suspend the trousers on the body of the wearer, but will simply provide points of attachment by means of which the trousers may be suspended for example by suspenders, or by attachment to the shirt of the wearer.

The shirt will incorporate some form of attachment means arranged along the line of the waistband of the trousers, that is to say the attachment means will be overlying the small of the back, at the back of the shirt and will be angled downwardly at each side and will be lowermost at the front of the shirt.

The trouser will also incorporate small ventilation slits located along the seams of the trousers on either side of the V-shaped crotch insert, and also a short distance along the front and back seams.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

FIGS. 6 and 7 are perspectives of a brief;

FIGS. 8 and 9 show an alternate form of trouser, and,

DESCRIPTION OF A SPECIFIC EMBODIMENT

Figure 1:
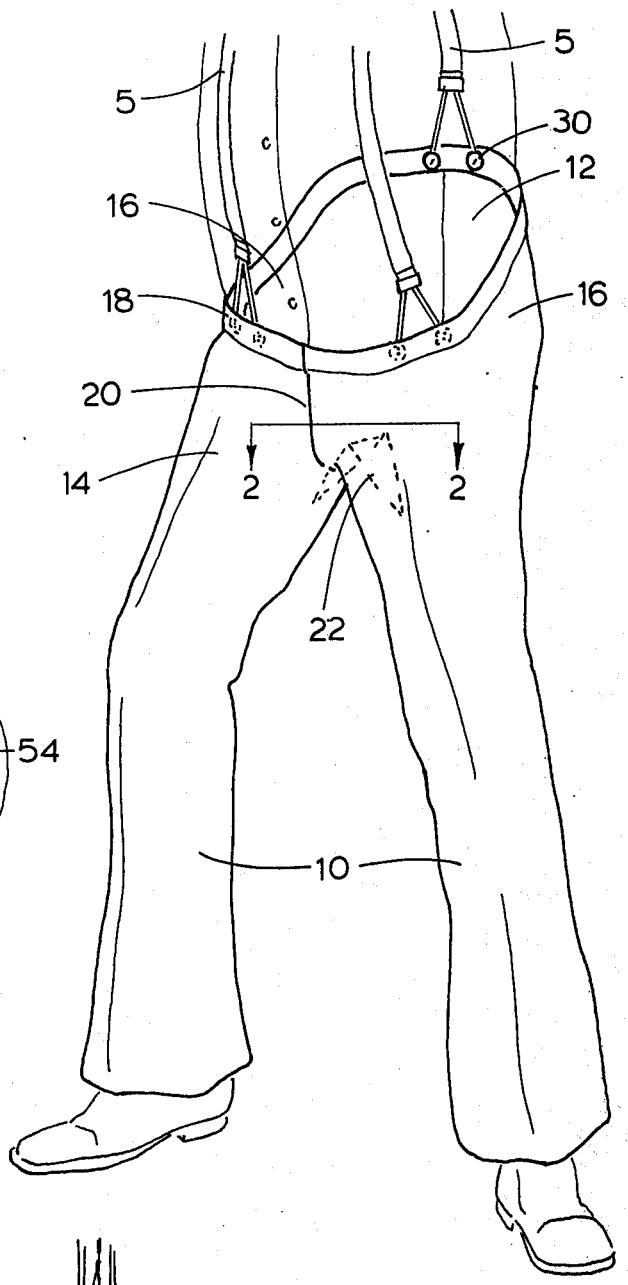
FIG. 1 is a perspective front illustration showing the trousers according to the invention suspended by suspenders.

Referring now to FIG. 1, it will be seen that the trousers according to the invention are shown as having conventional trouser legs 10 extending upwardly at the rear of the trousers to provide the seat, or hip covering portion 12. The front of the trousers, the front covering portion indicated generally as 14, covering from the legs up to the crease of the abdomen of the wearer will be seen to be very much lower than the rear portion 12. The portion shown generally as 16 covering the sides of the hips of the wearer will be seen to have an upper edge which is angled downwardly between the rear 12 and the front 14 of the trousers.

A waistband 18 is attached around the upper edges of the rear portion 12, side portion 16 and front portion 14 of the trousers. The waistband 18 will be seen to be at its highest point at the rear of the trousers, and to be angled downwardly on either side of the trousers and at its lowest point at the front.

The inner part of the front opening 20 extends downward from the waistband about 3½ inches. It is closed by a single button the top of which is about ½ to ¾ inch below the top of the waistband. A button is located in the outer part of the front opening.

Suspension of the trousers is in the form shown in FIG. 1 achieved by means of suspenders shown generally as S attached by any suitable means such as for example buttons 30 located on the waistband 18. Such suspenders S will of course have to be somewhat longer, in the front, than conventional suspenders.

As will be observed, the line followed by the waistband 18 essentially extends from the small of the back of the wearer, forward and down to the junction between the body trunk and the legs in front, and does not cover the abdomen. In this way, the abdomen of the wearer is free of constriction. There is no pressure on the bowels or other organs, either when the wearer is standing or, particularly, when the wearer is sitting, ie. working at a desk, riding in an automobile, or in public transportation, or seated in an auditorium. In other words, whereas wearing conventional trousers the wearer is subjected to considerable constriction and discomfort due to being seated or otherwise confined in a relatively constricted and uncomfortable form of garment, which causes digestive problems and discomfort, the wearer will now be free of these problems of body constriction.

Figure 2:
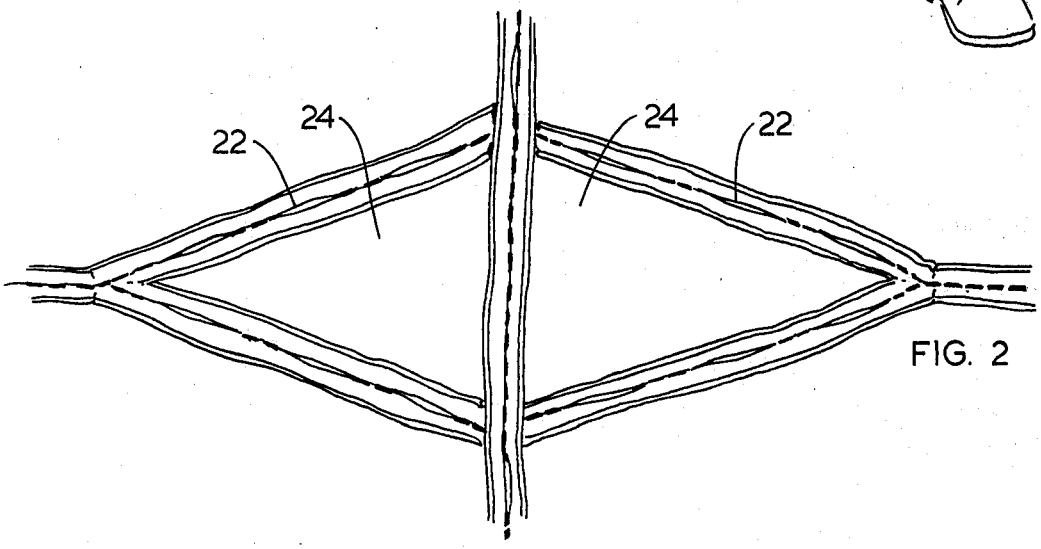
FIG. 2 is a section along the line 2—2 of FIG. 1.

According to a further feature of the invention, ventilation slits shown as 22, are provided in the crotch area of the trousers. Such ventilation slits are provided along the seams of the V-shaped crotch inserts (see FIG. 2).

Figure 3:
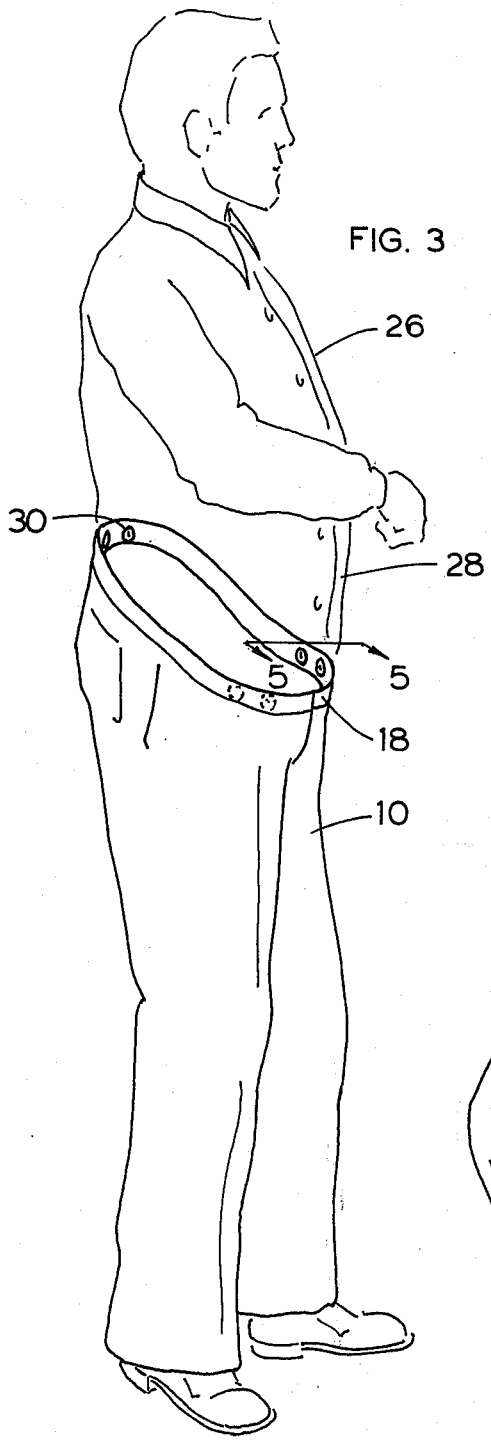
FIG. 3 is a perspective of the trousers according to the invention suspended by a shirt.
Figure 5:
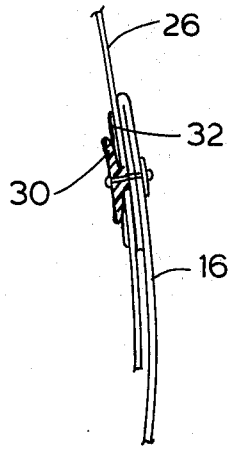
FIG. 5 is a section along the line 5—5 of FIG. 3.
Figure 4:
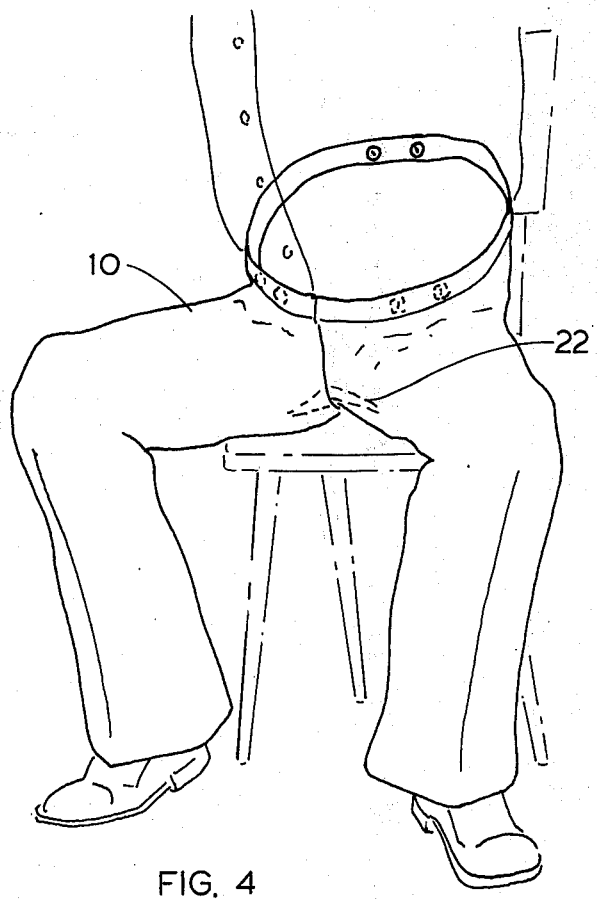
FIG. 4 is a front perspective illustration showing the advantages of the trousers according to the invention.

As shown in FIGS. 3, 4 and 5, an alternate form of suspension for the trousers according to the invention may be provided by a shirt 26. The shirt 26 has two rows, each of six reinforced button holes 28, lower at the front than the back, for receiving buttons 30 on trousers 10. The six button holes 28 are thus arranged around a path which is higher at the back than at the front of the shirt 26, and at the back lies over the small of the back or waist of the body, and at the front, lies at or slightly above the body crease, at the junction of the legs and the abdomen, and essentially describes a downwardly angled circular path, corresponding to the location of the waistband 18 of the trousers 10 according to the invention.

It will of course be appreciated that the buttons 30 are shown purely by way of example. The attachment means could equally well be for example a strip of entangling fibres known in the trade as "Velcro" (Trade Mark) or some other form of attachment means such as clip-like devices attached to the trousers, and clipping onto the fabric of the pants or shirt.

While the invention has been described essentially in connection with a pair of trousers, it will of course be appreciated that it is equally applicable to other types of legged garments. Thus it will apply to trousers for both men and women, and to other trouser-type garments such as pyjamas, shorts, briefs, underpants and the like. Referring specifically to FIG. 6, the invention is there illustrated in connection with a brief. Such briefs are typically made out of two-way stretch material, and may be suspended by the elasticity of the material, and also by the elasticity in the waistband.

In this type of garment, the briefs indicated as reference 34 will have a front panel 36 which is cut considerably lower than the rear panel 38, and will have a waistband 40 attached around the top of the front and rear panels which is higher at the back of the body than the front and describes an essentially downwardly slanted angle from the rear to the front of the garment. It will extend downwardly as low as, or lower than the trousers as illustrated in FIGS. 1 to 4. In addition such briefs will not have any seriously harmful effect on the body of the wearer since the garments have inherently considerably more give and elasticity than outer garments and the front waistband is not over any vital organs.

The brief is to be a low-rise type, made still lower in the front to follow the body line just below the abdomen. It is to be made of a one piece front and a one piece back, both pieces being joined at the sides.

It is to have, either a double thickness of material in front, or else a lining each one of which is to include the crotch area. It may be made of any material.

Where the invention is used in connection with for example pyjama trousers then they will be cut essentially as shown in FIGS. 1 to 4, and will be suspended principally by attachment to the shirt or jacket portion of the pyjamas which will be constructed in the same way as the shirt as shown in FIG. 6. For these reasons therefore the form of the invention when applied to pyjamas is not separately illustrated, it being understood that the details are essentially the same.

Trousers according to the invention may also be made in a two-part construction as shown in FIGS. 8 and 9. A back section 42 will have legs 44 and an upper edge 46 curved convexly in the same way as in FIGS. 1 and 2.

A front section 48 will have legs 50 and an upper edge 52 curved concavely, again as in FIG. 1.

When the two sections are seamed together, a waistband, (not shown) may be attached around the upper edge, and any suitable suspension means will also be attached.

The low front ventilated pants according to the invention are thus seen to have many inherent advantages over regular garments. The V-shaped crotch pieces may also incorporate ventilation in the form of a net-like material.

Figure 10:
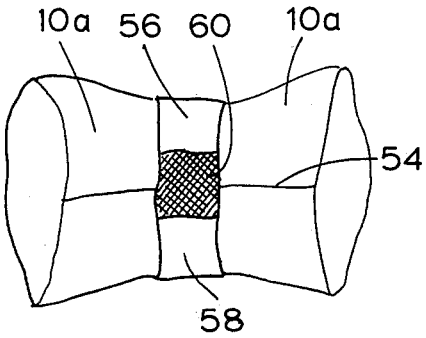
FIG. 10 shows an alternate form of vent.

As shown in FIG. 10 the trousers 10*a* having inside seams 54 may incorporate a front portion 56 and a rear portion 58 extending upwardly through the front and rear panels of the trousers. A centre vent panel 60 is incorporated between panels 56 and 58. Center panel 60 may be about three to six inches square and is made of a net-like material for ventilation purposes.

All the garments herein described may have partial or complete elastic-type waistbands.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Garment construction, for use in the construction of legged garments such as trousers, pyjamas, briefs, and the like said garment construction comprising;

a front panel for covering the body of the wearer from the body crease downward; said body crease being formed by the line of juncture between the legs and abdomen of the wearer when in a sitting position;

a rear panel for covering the hips, seat, and lower back of the wearer, said front and rear panels being joined between the crotch, and along either side to form an integral garment;

said rear panel having an upper edge which is highest at its center point, and slanting continuously and uniformly downwardly towards each side thereof, and said front panel having an upper edge at each side thereof meeting and merging with the upper edge of the rear panel, and slanting continuously and uniformly downwardly towards a lowest point at about the center of the front panel, the front panel thereby being substantially lower than the rear panel, a waistband extending around the upper edge of said rear and front panels and being at its highest point at the center of the rear panel, and extending in a continuously and uniformly downwardly slanting direction towards its lowest point adjacent the center of the front panel, said waistband essentially following said body crease whereby to leave the front portion of the abdomen of the wearer unconstricted by said garment, and, suspension means for suspending said garment, and being attachable at spaced points around the waistband, said suspension means being longer at the front than at the back.

2. The garment construction as claimed in claim 1 including buttons attached to the front and back waistband regions of the garment, the buttons at the front of said garment being lower than the buttons at the back of said garment.

3. The garment construction as claimed in claim 2 wherein said suspension means comprises a shirt garment for clothing at least a portion of the upper body of the wearer, and having a front panel which is lower than the rear panel for covering the front of the abdomen of the wearer, and attachment means formed around the lower portion of said shirt, for attachment to the waistband of said lower garment whereby to provide inherent support for said lower garment without the use of suspenders and the like.

4. The garment construction as claimed in claim 1 including ventilation means in the crotch area of the garment.

5. The garment construction as claimed in claim 4 wherein said garment incorporates generally V-shaped crotch inserts, and wherein said ventilation means comprises small slit-like openings along the seams on either side of said V-shaped inserts.

6. The garment construction as claimed in claim 4 wherein said ventilation means is in the form of panel means incorporated in the crotch area of the garment, said panel means being formed of a net-like material.

7. The garment construction as claimed in claim 6 including vertical panel means extending up the front and rear of the garment, of generally rectangular shape, and wherein said net-like panel forms an intermediate portion of said vertical panels, in the region of the crotch area of the garment.

8. The garment construction as claimed in claim 1 wherein said garment is a legged garment such as a trouser, pyjama or the like, wherein said garment is made of two panels namely a front panel and a rear panel each being cut with leg portions and one said panel providing a front panel, the other said panel providing a rear panel.

9. Undergarment construction, for the construction of a brief or the like for clothing the lower part of the body said undergarment construction comprising;

a front panel portion for covering the body of the wearer from the body crease downward; said body crease being formed by the line of juncture between the legs and abdomen of the wearer when in a sitting position;

a rear panel portion for covering the hips and seat of the wearer, said front and rear panels being joined in the crotch region, and along either side whereby to provide an integral garment;

the rear panel having a predetermined height, at about its center, and the upper edge being slanted continuously and uniformly downwardly towards each side, and the front panel having its lowest point at the center, and the upper edge being slanted continuously and uniformly upwardly towards each side, and merging with the upper edge of the rear panel, and there being waistband means extending around said upper edges of said rear and front panels, said waistband means being at its highest point at the center of the rear panel, and slanting continuously and uniformly downwardly and forwardly, being at is lowest point at the center of the front panel.

* * * * *